US008562257B2

(12) United States Patent
Westerbeek et al.

(10) Patent No.: US 8,562,257 B2
(45) Date of Patent: Oct. 22, 2013

(54) SYSTEM FOR AND METHOD OF INSTALLING FOUNDATION ELEMENTS IN A SUBSEA GROUND FORMATION

(75) Inventors: Jan Albert Westerbeek, Spijkenisse (NL); Johannes Louis Leonardus Hessels, Mierlo (NL)

(73) Assignee: IHC Holland IE B.V., Sliedrecht (NL)

( * ) Notice: Subject to any disclaimer, the term of this patent is extended or adjusted under 35 U.S.C. 154(b) by 238 days.

(21) Appl. No.: 12/952,256

(22) Filed: Nov. 23, 2010

(65) Prior Publication Data

US 2011/0123277 A1 May 26, 2011

(30) Foreign Application Priority Data

Nov. 24, 2009 (EP) ..... 09176850

(51) Int. Cl.
*E02D 7/02* (2006.01)

(52) U.S. Cl.
USPC ..... 405/232; 405/228; 173/207

(58) Field of Classification Search
USPC ..... 405/228, 232, 249; 173/206, 207
See application file for complete search history.

(56) References Cited

U.S. PATENT DOCUMENTS

| | | | |
|---|---|---|---|
| 3,820,346 | A | 6/1974 | Wisotsky |
| 4,043,405 | A | 8/1977 | Kuhn |
| 4,089,165 | A | 5/1978 | Reineke, Jr. |
| 4,367,800 | A | 1/1983 | Arentsen |
| 4,964,473 | A | 10/1990 | Arentsen |
| 5,894,781 | A | 4/1999 | Kuvshinov |
| 2007/0277989 | A1 | 12/2007 | Hessels et al. |

FOREIGN PATENT DOCUMENTS

| | | | |
|---|---|---|---|
| EP | 301114 | | 7/1991 |
| EP | 301116 | | 7/1991 |
| EP | 1748109 | A1 | 1/2007 |
| GB | 1397137 | | 6/1975 |
| GB | 1452777 | | 10/1976 |
| GB | 2078148 | | 2/1980 |
| GB | 2069034 | A | 8/1981 |
| GB | 2069902 | | 9/1981 |
| JP | 58210214 | A | 12/1983 |
| WO | WO 2004051004 | | 6/2004 |

OTHER PUBLICATIONS

Extended European Search Report issued in connection with European Patent Application No. EP09176850.7 on May 25, 2010.

*Primary Examiner* — Sean Andrish
(74) *Attorney, Agent, or Firm* — Westman, Champlin & Koehler, P.A.

(57) ABSTRACT

The invention relates to a system for installing or removing foundation elements, such as piles, anchors, and conductors, in a subsea ground formation, comprising an impact weight, an hydraulic circuit in turn comprising an hydraulic cylinder for lifting and/or accelerating the impact weight respectively away from and towards the element, the cylinder comprising a piston connected to the impact weight, and wherein a pump for generating an underpressure in the hydraulic cylinder such as to lift and/or accelerate the impact weight by means of this underpressure.

20 Claims, 5 Drawing Sheets

SYSTEM FOR AND METHOD OF INSTALLING FOUNDATION ELEMENTS IN A SUBSEA GROUND FORMATION

CROSS-REFERENCE AND PRIORITY CLAIM TO RELATED APPLICATIONS

This application claims priority to European Patent Application No. EP09176850.7, filed Nov. 24, 2009, entitled "System for and method of installing foundation elements in a subsea ground formation," which application is incorporated herein by reference and made a part hereof in its entirety.

BACKGROUND

GB 2 078 148 relates to a drop hammer apparatus, wherein a hammer (E) is interconnected with a piston (B) by means of a piston rod. An upright cylinder (A) is open at its upper end, the piston is slidable within the cylinder and the piston rod is slidable through the lower end of the cylinder. The space within the cylinder below the piston is selectively connected to a source (C) of pressurized liquid e.g. water and exhausted by means of a valve (D).

GB 1 397 137 discloses an apparatus for the driving of piles underwater and comprising a hollow tube connected to the pile, the tube being sequentially evacuated by pump and filled with ambient water by opening a valve at the end of the tube, the incoming water, when it strikes the lower end of the tube or any residual water therein producing a driving pulse. The embodiment shown in FIG. 13 involves repetitively and alternately raising a piston (160) with a winch (125) and dropping the piston. Raising of the piston evacuates an enclosure defined by the pile tip and side walls. Quick release of the piston and rapid descent thereof through the pile accelerate a mass of water above the piston. A similar system is shown in U.S. Pat. No. 3,820,346.

GB 2 069 902 relates to a submersible hammer (21) for driving piles comprising a piston (36) and cylinder (35) assembly provided in conjunction with a ram (30) to move the same upwardly when the piston is lifted. Sea water is supplied as power medium at a pressure in excess of the ambient pressure and an inlet valve (50) effects fluid communication between the pressurized sea water and the piston to lift the piston, and thus the ram, and to terminate such communication when the piston reaches a predetermined level. An exhaust valve (51) vents the sea water allowing the piston and ram to fall until the ram impacts the upper end of a pile to drive the same into the sea bed.

GB 1 452 777 relates to a gas discharge powered pile driver comprising an "airgun". WO 2004/051004 discloses a "pile-driving apparatus comprising a pile, a shoe tip coupled to a toe of the pile, and a drill string disposed within the pile." U.S. Pat. No. 4,964,473 relates to a method for driving a hydraulic submerged tool, wherein the hydraulic pressure energy is generated in a submerged power converter. U.S. Pat. No. 4,089,165 relates to a water pressure-powered pile driving hammer. The piston of the pile driving hammer is raised by hydraulic (water) pressure. In the underwater pile driving apparatus according to U.S. Pat. No. 4,367,800 the hammer is movable upwards and downwards in a housing which, in operation, is filled with a liquid which is present both above and below the hammer, the hammer being driven at least on the upwards direction by a driving liquid which is pressurized by a motor driven pump located on or adjacent the housing and which is the same as the liquid in which the hammer moves. Other prior art relating to underwater pile driving includes EP 301 114, EP 301 116 and U.S. Pat. No. 4,043,405.

Systems (denoted by numeral 1 in FIGS. 1 and 2) of this type are generally known and usually comprise an impact weight (2), a hydraulic cylinder (3), a piston (4) reciprocatingly accommodated in the hydraulic cylinder (3) and connected to the impact weight (2), high and low pressure accumulators (5, 6), often also referred to as feed and return accumulators (5, 6), a valve system (7) for alternately connecting the hydraulic cylinder (3) to the high and low pressure accumulators (5, 6), a tank (8) for a hydraulic medium, such as hydraulic oil, and a pump (9) for pressurizing the hydraulic medium, i.e. for providing the hydraulic energy required to operate the system.

If the impact weight is accelerated by means of a gas (FIG. 1), a gas spring also known as "cap" (10) is positioned above the piston (4). If the impact weight is accelerated by means of the hydraulic medium (FIG. 2), the valve system (7) comprises a reversing valve for alternately supplying the hydraulic medium to the cylinder spaces above and below the piston (4).

The pressure in and hence the 'stiffness' of the system, in particular the pressure in the accumulators and, if present, the gas spring, increases with increasing depth. At extreme depths, such as 1500 meters and deeper, the pressure in the system causes several problems. E.g., it is no longer possible to fill the accumulators from pre-filled gas cylinders. High pressure compressors are required instead.

Further, during acceleration of the impact weight, the pressure in the return accumulator increases to a much greater extent, in turn requiring a higher pressure in the gas spring, if present, and in the feed accumulator. In hydraulically driven systems (FIG. 2), as disclosed in for instance U.S. Pat. No. 4,367,800, to ensure sufficient acceleration at the end of the stroke a very high initial pressure in the feed accumulator is required.

In general, at higher pressures, variations in the operating pressure are amplified, which complicates setting and maintaining the striking energy at a preselected level.

It is an object of the present invention to improve the system according to the opening paragraph.

SUMMARY

The invention relates to a system for and a method of installing or removing (decommissioning) foundation elements, such as piles, anchors, and conductors, in a subsea ground formation.

To this end, the system according to the present invention comprises a pump for generating an underpressure in the hydraulic cylinder such as to lift and/or accelerate the impact weight by means of this underpressure. Examples of suitable pumps include electrically or hydraulically driven piston pumps.

By generating an underpressure in e.g. the low-pressure (return) accumulator or return conduit, the pressure required for accelerating the impact weight is also reduced, thus reducing the problems discussed above.

The (relative) underpressure that can be generated by means of the pump increases with increasing depth. Current systems work with pressure differences of at least 50 bar. Accordingly, it is preferred that, during operation, the pump for generating an underpressure is positioned or positionable at a depth of at least 500 meters, preferably at least 1000 meters below sea level. The pump is preferably integrated in a so-called underwater power pack which receives electrical or hydraulic power from a surface vessel or facility via e.g. an umbilical or drill string.

To further facilitate relatively low operating pressures, it is preferred that the pump for generating an underpressure is positioned or positionable at a depth of less than 1000 meters, preferably less than 500 meters above the hydraulic cylinder and more preferably at substantially the same depth as the hydraulic cylinder.

In a preferred embodiment, the hydraulic cylinder is connected, e.g. via or in conjunction with a high pressure accumulator and a valve, also to the pressure line of the pump for generating an underpressure, i.e. a single pump is employed to generate both an underpressure on one side of the piston in the hydraulic cylinder and a relatively high pressure on the other side of the piston, obtaining a 'closed loop'.

To prevent the free piston typically present in the accumulator(s) from hitting the bottom of the accumulator, it is preferred that the system comprises a regulator for maintaining the amount of hydraulic fluid in the hydraulic circuit at a substantially constant level. Usually, systems for subsea installation and removal of foundation elements comprise a unit, known as scavenger, for withdrawing hydraulic fluid from the circuit and subsequently treating, e.g. cooling, filtering, dewatering, degassing, and/or returning the fluid. It is preferred that the regulator is integrated in this unit.

The invention further relates to a method of installing or removing foundation elements, such as piles, anchors, and conductors, in a subsea ground formation, by means of a hydraulic driver comprising an impact weight, a hydraulic cylinder, and a piston accommodated in the hydraulic cylinder and connected to the impact weight, which method comprises the steps of mounting the impact driver on a foundation element, driving the foundation element into respectively out of the ground formation by alternately lifting and accelerating the impact weight respectively away from and towards the element, wherein the impact weight is lifted or accelerated by means of an underpressure above or beneath the piston respectively.

Within the framework of the present invention "underpressure" is defined as a pressure lower than the pressure that prevails in the surroundings of the system. It is noted that in prior art systems underpressure can arise e.g. from inertia of moving components, in particular from the ram at the end of lifting or directly after impact when bouncing upwards. However, these effects are small compared to the underpressure generated by a pump in accordance with the present invention and insufficient to drive the impact weight autonomously.

The invention will now be explained in more detail with reference to the figures, which show a preferred embodiment of the present system.

BRIEF DESCRIPTION OF THE DRAWINGS

It is noted that the figures are schematic in nature and that details, which are not necessary for understanding the present invention, may have been omitted. Elements that are identical or perform the same or substantially the same function are denoted by the same numeral.

DETAILED DESCRIPTION

Figure 1:
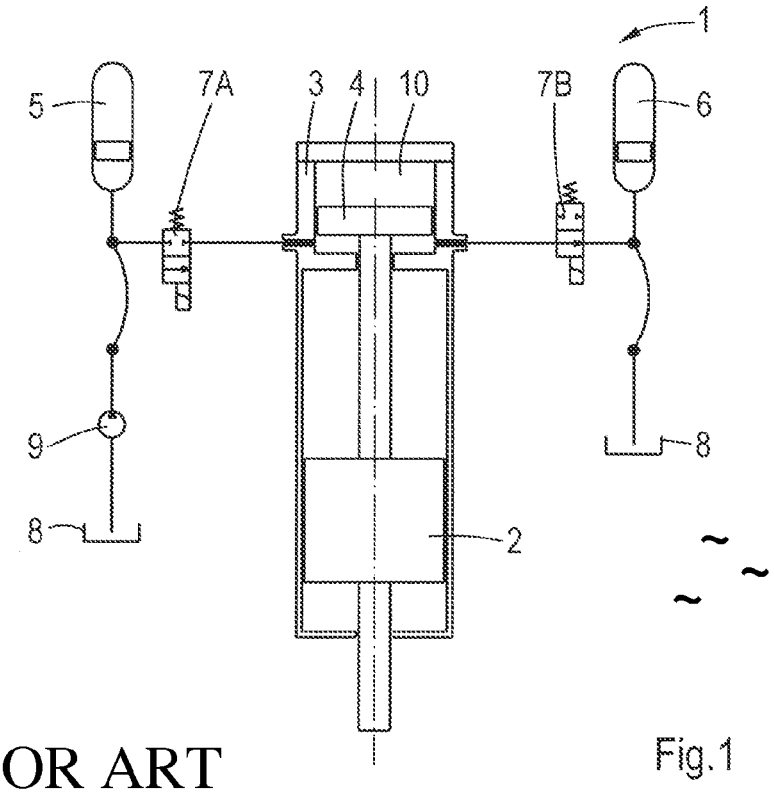
PRIOR ART Fig.1
FIGS. 1 and 2 show prior art systems comprising, respectively, a gas spring and a reversing valve for hydraulically operating the system.
Figure 2:
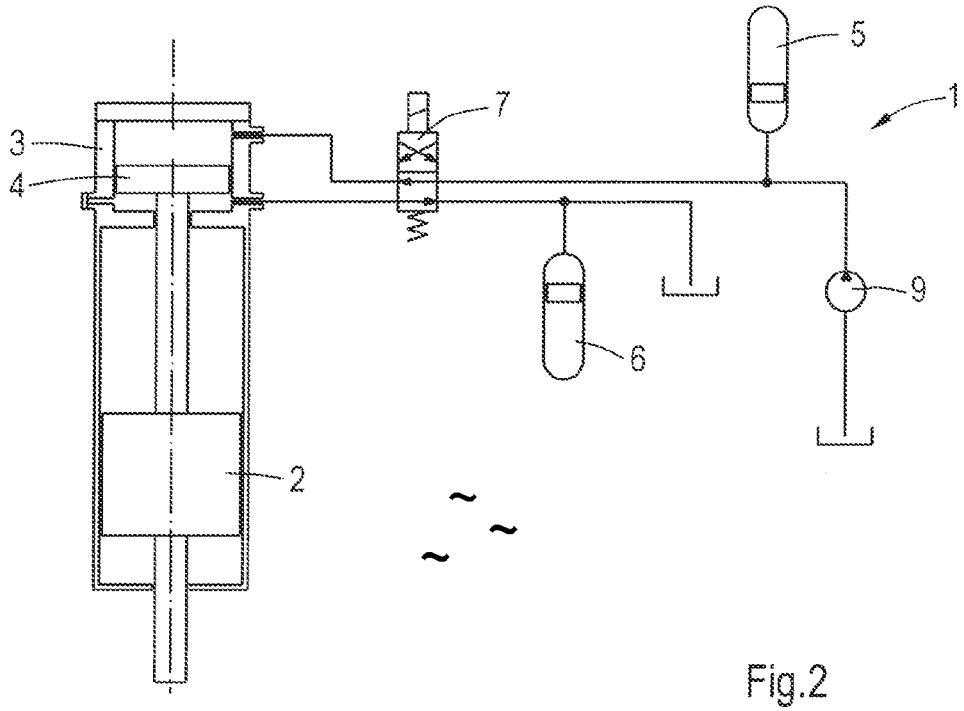
Fig.2 PRIOR ART
Figure 3:
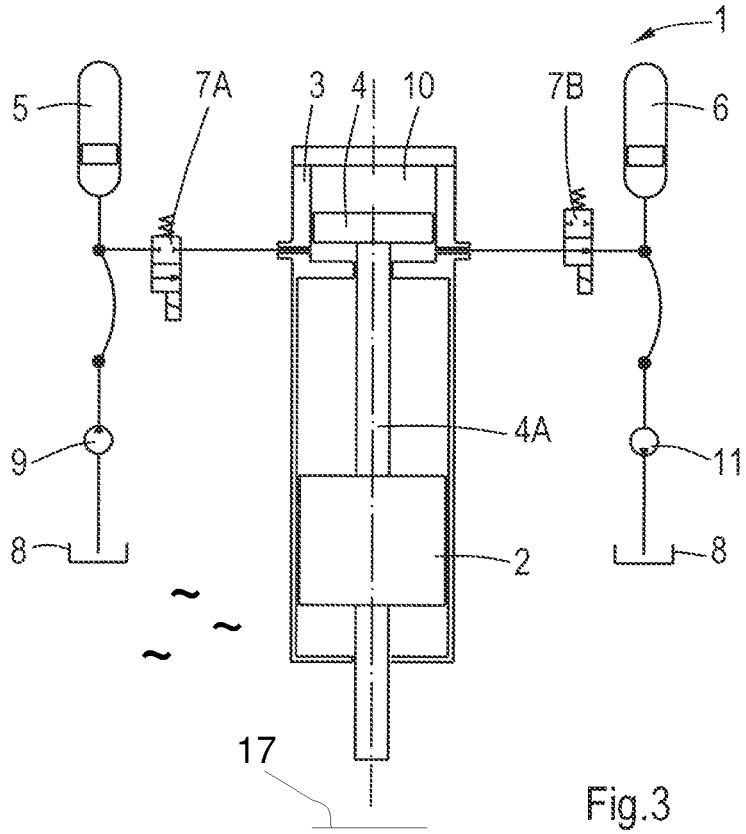
FIGS. 3 and 4 show systems similar to those in FIGS. 1 and 2 comprising a pump for generating an underpressure in accordance with the present invention.

FIG. 3 shows a first embodiment of the system 1 according to the present invention, which comprises an impact weight 2, a hydraulic cylinder 3, a piston 4 reciprocatingly accommodated in the hydraulic cylinder 3 and connected to the impact weight 2 by means of a rod 4A, high and low pressure accumulators 5, 6, and first and second valves 7A, 7B for alternately connecting the cylinder space beneath the piston 4 in the hydraulic cylinder 3 to the high and low pressure accumulators 5, 6. The system further comprises a tank 8 for a hydraulic medium, such as hydraulic oil, a first or feed pump 9 for pressurizing the hydraulic medium and connected, via the high pressure accumulator 5 and the first valve 7A, to the hydraulic cylinder 3, a gas spring or "cap" 10 above the piston 4, and a second pump 11 for generating an underpressure in the hydraulic cylinder 3.

When the first valve 7A is open and the second valve 7B is closed, the high pressure accumulator 5 communicates with the cylinder space beneath the piston 4 and the piston 4 and impact weight 2 are lifted by the hydraulic medium and the medium, typically air or water, surrounding (the tip of) the impact weight against the action of the gas spring 10. When the first valve 7A is closed and the second valve 7B is open, the hydraulic medium is withdrawn from beneath the piston 4 by the underpressure in the return accumulator 6 and the suction line of the second pump 11 and the impact weight 2 is accelerated by the gas spring 10 in opposite direction, i.e. typically towards a foundation element 17.

More specifically, with the system including e.g. an IHC Hydrohammer S-90 and an underwater power pack accommodating the pump for generating underpressure both at a depth of e.g. 2000 meters, the pump can generate an underpressure of up to approximately 200 bar, enabling operating pressures in the high and low pressure accumulators and the cap of approximately 180 bar, 2 bar, and 185 bar, respectively. I.e., during lifting the sum of the pressure of the gas surrounding the impact weight and the pressure of the hydraulic medium beneath the piston results in a force greater than the force resulting from the gas pressure in the cap. During acceleration in the opposite direction, the pressure of the hydraulic medium beneath the piston is reduced almost to zero and said sum of pressures results in a force smaller than the force resulting from the gas pressure in the cap.

If the underwater power pack is positioned at a different depth than the hammer, e.g. at 1000 meters, the pump can generate an underpressure of up to approximately 100 bar, still enabling operating pressures as low as approximately 280 bar, 200 bar, and 100 bar, respectively.

In comparison, if the pump is located at sea level, e.g. on deck of a ship, the operating pressures are approximately 380 bar, 215 bar, and 200 bar, see also the Table below. This effect becomes more pronounced with increasing depth.

| Table for S-90 | Pump on deck | at 1000 m | at 2000 |
|---|---|---|---|
| HP accu (bar) | 380 | 280 | 180 |
| LP accu (bar) | 200 | 100 | 2 |
| Cap (bar) | 215 | 200 | 185 |

Figure 4:
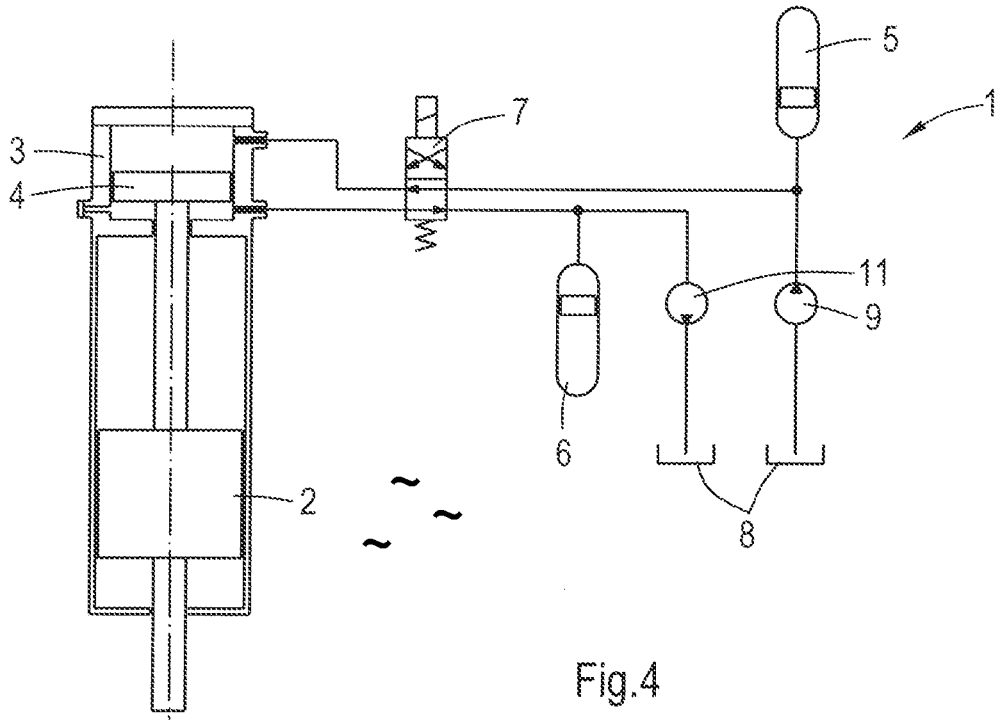

FIG. 4 shows a hydraulically driven system 1 comprising a second pump 11 for generating an underpressure in the low pressure accumulator 6 and a 4/2 valve 7 for alternately connecting the cylinder spaces beneath and above the piston 4 in the hydraulic cylinder 3 to the high and low pressure accumulators 5, 6, thus lifting the impact weight and reversing the connections to accelerate it in opposite direction. In this system, pressures are obtainable similar to those in the Table above, e.g. with the hammer and the pump at a depth of 2000 meters and the pump operating at maximum capacity the pressures in the high and low pressure accumulators amount to approximately 180 bar and 2 bar, respectively.

Figure 5:
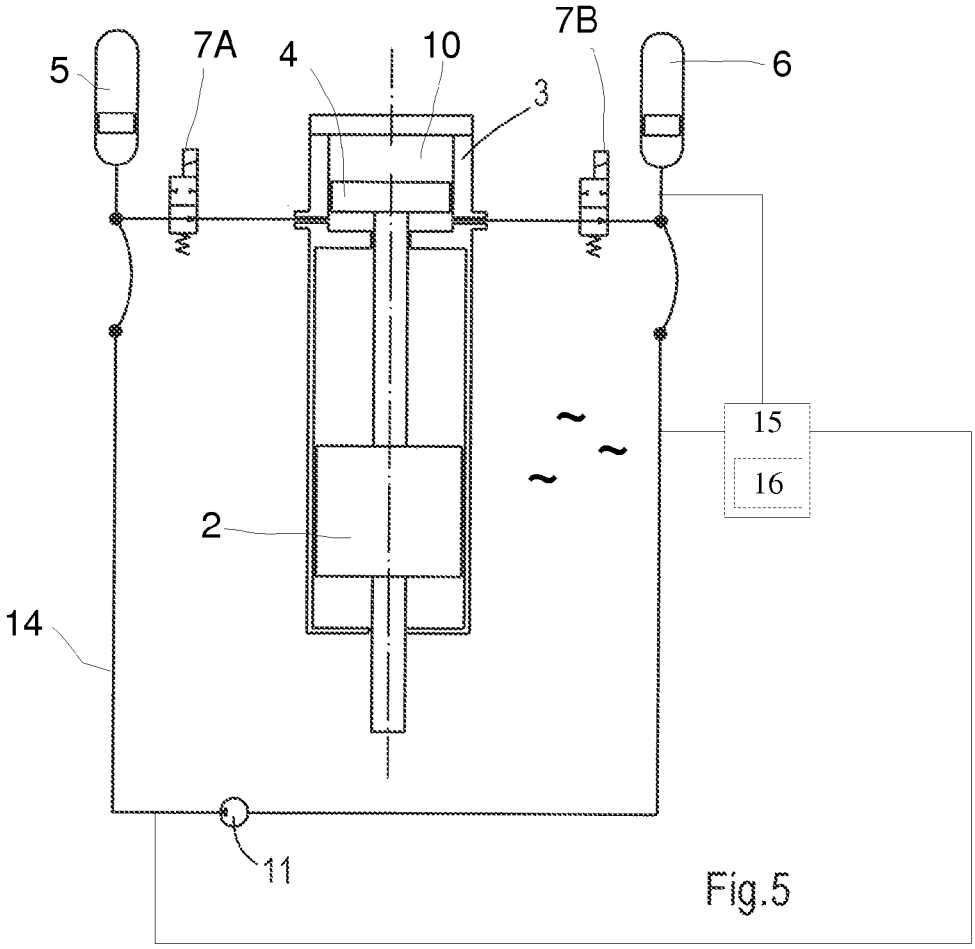
FIGS. 5 and 6 show closed loop systems.
Figure 6:
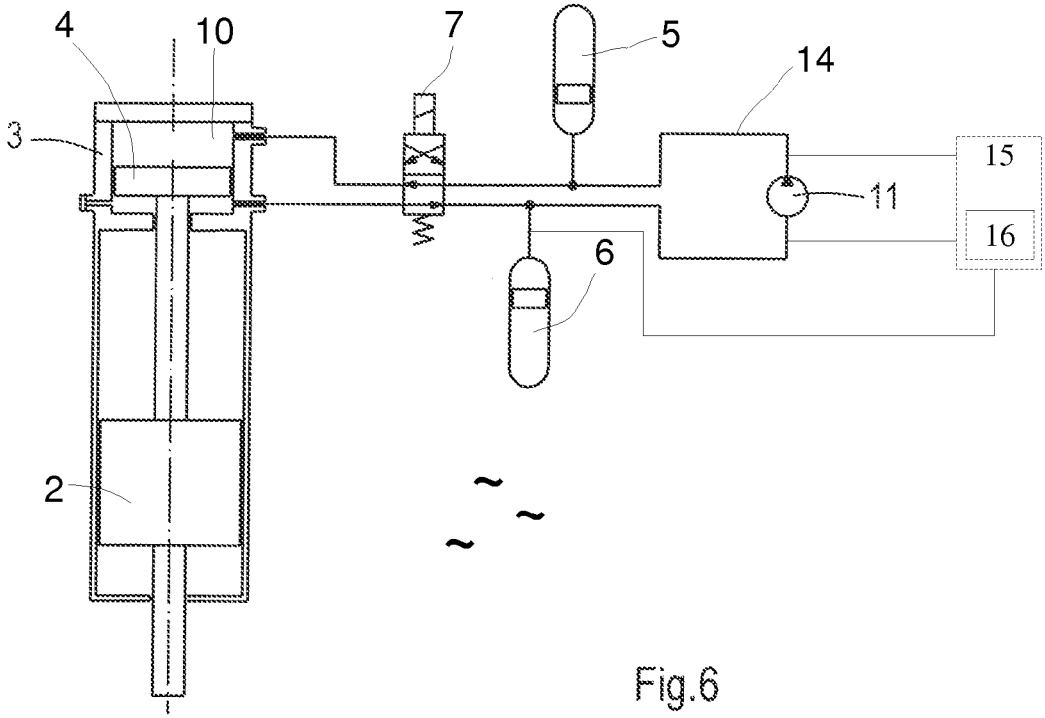

As shown in FIGS. 5 and 6, the systems according to the present invention can be simplified by connecting the hydraulic cylinder 3 not just to the suction line of the pump 11 for generating an underpressure but also to its pressure line 14. I.e., a single pump fulfils the tasks of generating an underpressure on the low pressure (hydraulic fluid outlet) side of the hydraulic cylinder and a relatively high pressure on the high pressure (hydraulic fluid inlet) side of the hydraulic cylinder thus obtaining a 'closed loop'.

In such embodiments, a scavenger is preferably added to the system for withdrawing hydraulic fluid from the circuit and subsequently treating, e.g. cooling, filtering, dewatering and/or degassing, the fluid. Further, it is preferred that the scavenger is arranged to maintain the amount of hydraulic fluid in the hydraulic circuit at a substantially constant level, inter alia to prevent the free pistons in the accumulators from hitting the bottoms of the accumulators.

Figure 7:
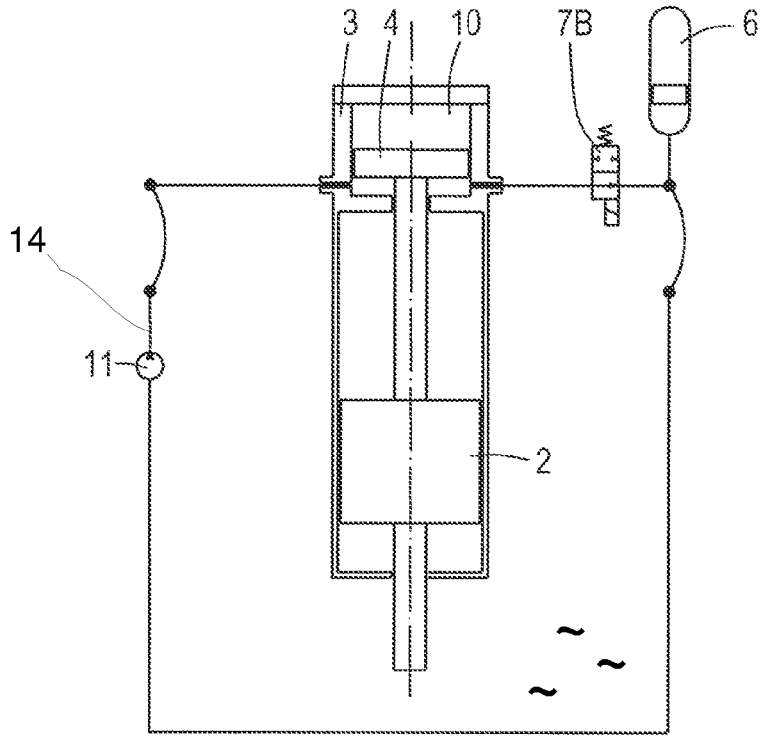
FIGS. 7 and 8 show systems without a high pressure accumulator.
Figure 8:
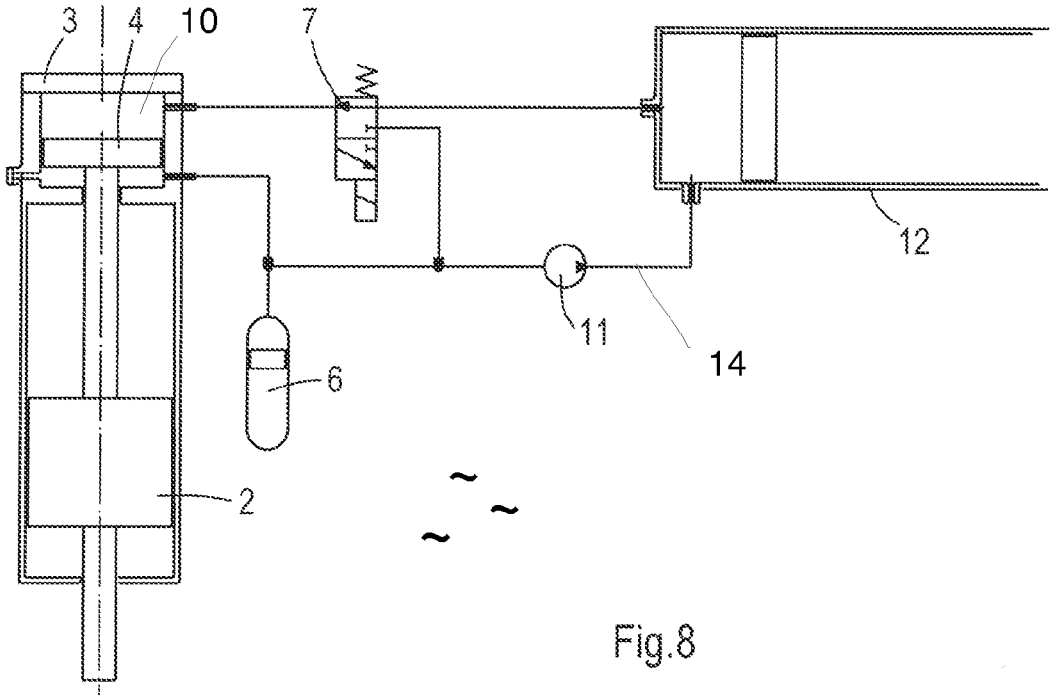

Also, as shown in FIGS. 7 and 8, the system can be simplified even further by omitting the high pressure accumulator and the corresponding valve. In systems comprising a gas spring 10, the system can be operated merely by means of the valve 7B between the hydraulic cylinder 3 and the low pressure accumulator 6. When this valve 7B is closed, the pressure line 14 of the pump 11 communicates with the cylinder space beneath the piston 4 and the piston 4 and impact weight 2 are lifted by the hydraulic medium against the action of the gas spring 10. When the valve 7B is open, the hydraulic medium is withdrawn from beneath the piston 4 by the underpressure in the return accumulator and the suction line of the pump 11, i.e. the hydraulic medium is circulated through the system by the pump, and the impact weight is accelerated by the gas spring.

If the system is at a sufficient depth, e.g. at depths greater than 500 meters, preferably greater than 1000 meters, the gas spring can also be omitted by establishing fluid communication between the cylinder space above the piston and the surroundings, e.g. by a hydraulic cylinder that is open at one end.

In hydraulically operated systems, shown in FIG. 8, in a first position of the valve, in this example a 3/2 valve 7, the low pressure accumulator 6 and the suction line of the pump 11 communicate with the cylinder space beneath the piston 4 but the cylinder space above the piston 4 communicates with the pressure line 14 of the pump 11 and the impact weight 2 is accelerated by the pressure difference. A compensator 12 can be included to guarantee a sufficient supply of hydraulic medium to the cylinder space above the piston 4. In the other position of the valve 7, the low pressure accumulator 6 and the suction line of the pump 11 communicate with both the cylinder space beneath and the cylinder space above the piston 4 and the impact weight 2 is lifted by the medium, typically air or water, surrounding the impact weight 2.

In further embodiments, the impact weight is accessible for water from the surroundings such that, during operation, the weight reciprocates in water. Although dissipation is thus increased, the system no longer requires the feeding of gas to the hammer.

Figure 9:
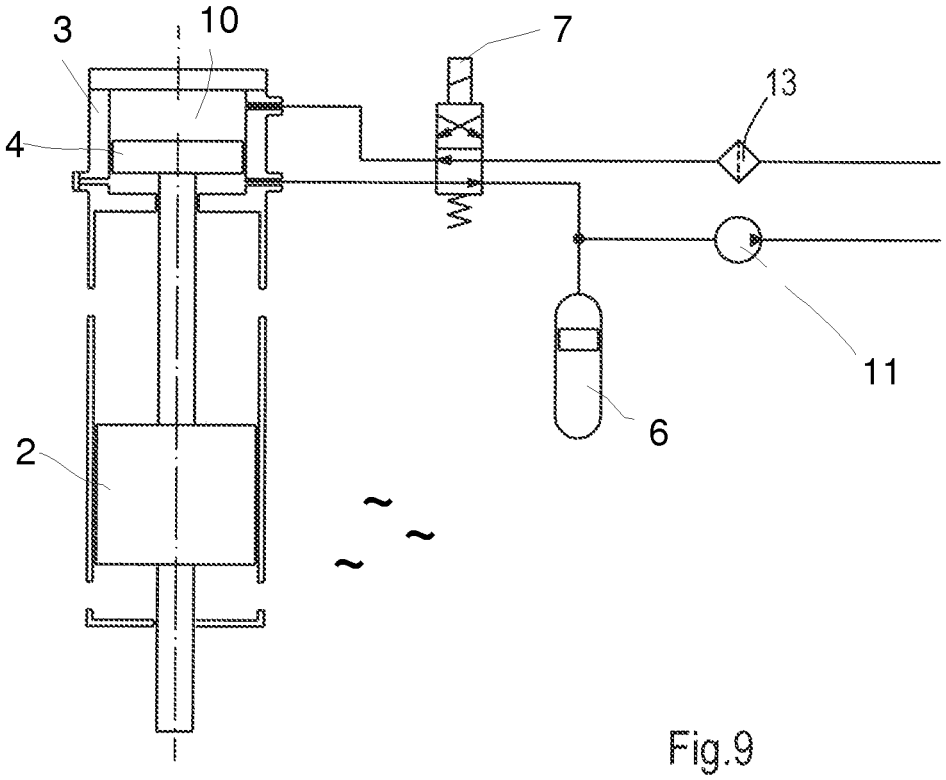
FIGS. 9 and 10 show systems wherein the impact weight reciprocates in water and is driven by water as the hydraulic medium.
Figure 10:
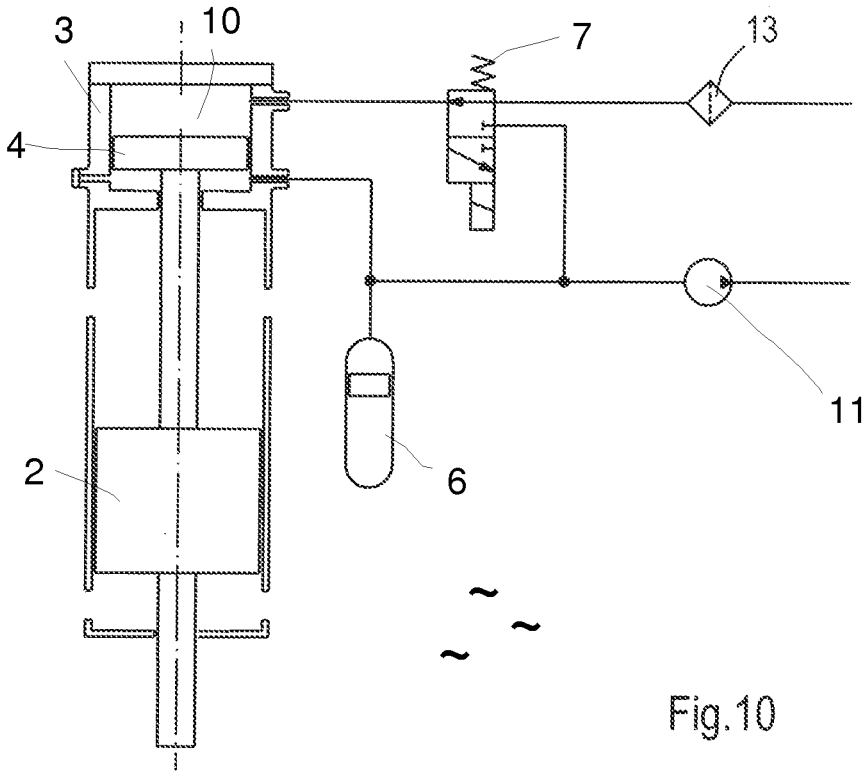

In the embodiments shown in FIGS. 9 and 10, the hydraulic circuit is arranged to withdraw water from and exhaust water to the surroundings, i.e. seawater is employed as the hydraulic medium for driving the impact weight. In such embodiments, it is preferably that water withdrawn from the surroundings passes through a filter 13 first.

It is understood that any feature described in relation to any one embodiment may be used alone, or in combination with other features described, and may also be used in combination with one or more features of any other of the embodiments, or any combination of any other of the embodiments.

The invention claimed is:

1. A system for installing or removing foundation elements in a subsea ground formation, comprising:

an impact weight, an hydraulic circuit in turn comprising an hydraulic cylinder for lifting and accelerating the impact weight away from and towards, respectively, the foundation element, the cylinder comprising: a piston accommodated in the hydraulic cylinder and connected to the impact weight, and wherein the system further comprises a pump for generating an underpressure in the hydraulic cylinder such as to lift or accelerate the impact weight using said underpressure, said underpressure is a pressure lower than the pressure prevailing at the depth of the hydraulic cylinder.

2. The system according to claim 1, wherein the pump for generating the underpressure is positioned or capable of being positioned at a depth of at least 500 meters below sea level.

3. The system according to claim 1, wherein the pump for generating the underpressure is positioned or capable of being positioned at a depth of less than 1000 meters above the hydraulic cylinder.

4. The system according to claim 1, wherein the hydraulic cylinder is connected to the pressure line of the pump for generating the underpressure.

5. The system according to claim 4, comprising a regulator for maintaining an amount of hydraulic fluid contained in the hydraulic circuit at a substantially constant level.

6. The system according to claim 5, comprising a unit for withdrawing hydraulic fluid from the circuit, treating, and returning the fluid, wherein the regulator is integrated in or part of said unit.

7. The system according to claim 1, wherein the hydraulic cylinder is connected directly to a feed pump, a compensator or the surrounding water.

8. The system according to claim 1, wherein, when submerged, the impact weight is accessible for water from the surrounding water such that the weight reciprocates in water.

9. The system according to claim 1, wherein the hydraulic circuit is arranged to withdraw water from and exhaust water to the surrounding water.

10. A method of installing or removing foundation elements in a sub-sea ground formation, by using a hydraulic driver comprising an impact weight, a hydraulic cylinder, and a piston accommodated in the hydraulic cylinder and connected to the impact weight, the method comprising:

mounting the hydraulic driver on a foundation element, driving the foundation element into the ground formation by accelerating the impact weight towards the foundation element or pulling the foundation element out of the ground formation by lifting the impact weight away from the foundation element, wherein said impact weight is lifted or accelerated by using an underpressure above or beneath the piston respectively and said underpressure is generated by a pump, and said underpressure is a pressure lower than the pressure prevailing at the depth of the hydraulic cylinder.

11. The method according to claim 10, wherein the underpressure is generated by the pump which is positioned at a depth of at least 500 meters below sea level.

12. The method according to claim 10, wherein the underpressure is generated by the pump which is positioned at a depth of less than 1000 meters above the hydraulic cylinder.

13. The method according to claim 10, wherein the impact weight reciprocates in water.

14. The method according to claim 10, wherein the driver is operated by using water taken from the surrounding water.

15. The method according to claim 10, wherein the underpressure is generated by the pump which is positioned at a depth of at least 1000 meters below sea level.

16. The method according to claim 10, wherein the underpressure is generated by the pump which is positioned at a depth less than 500 meters above the hydraulic cylinder.

17. The method according to claim 10, wherein the underpressure is generated by the pump which is positioned at a depth at substantially the same depth as the hydraulic cylinder.

18. The system according to claim 1, wherein the pump for generating the underpressure is positioned or capable of being positioned at a depth of at least 1000 meters below sea level.

19. The system according to claim 1, wherein the pump for generating the underpressure is positioned or capable of being positioned at less than 500 meters above the hydraulic cylinder.

20. The system according to claim 1, wherein the pump for generating the underpressure is positioned or capable of being positioned at substantially the same depth as the hydraulic cylinder.

* * * * *